United States Patent [19]

Tatsuno et al.

[11] Patent Number: 4,911,954

[45] Date of Patent: Mar. 27, 1990

[54] METHOD OF COATING AN ALUMINUM WHEEL

[75] Inventors: Tadayoshi Tatsuno; Komaharu Matsui, both of Hiratsuka; Mituo Wakimoto, Isehara; Syoji Takahashi, Hiratsuka, all of Japan

[73] Assignee: Kansai Paint Company, Limited, Amagasaki, Japan

[21] Appl. No.: 248,694

[22] Filed: Sep. 23, 1988

[30] Foreign Application Priority Data

Sep. 25, 1987 [JP] Japan ..... 62-240340

[51] Int. Cl.[4] ..... B05D 1/36; B05D 7/00

[52] U.S. Cl. ..... 427/409; 428/458; 428/461; 428/462; 428/463

[58] Field of Search ..... 427/388.2, 409; 204/181.7; 428/458, 461–463

[56] References Cited

U.S. PATENT DOCUMENTS 4,208,223 6/1980 Hofstatter ..... 427/387 X 4,308,121 12/1981 Hazan ..... 204/181.7

*Primary Examiner*—Michael Lusignan

*Attorney, Agent, or Firm*—Armstrong, Nikaido, Marmelstein, Kubovcik & Murray

[57] ABSTRACT

A method of coating an aluminum wheel comprises:

coating the aluminum wheel with a coating composition (A) comprising a thermosetting or thermoplastic resin having a glass transition temperature of −25° to 60° C. and an elongation of at least 30% (at 20° C.) when in the form of a cured coating, and finely divided transparent silica and/or alumina 0.005 to 0.05 μm particle size, in an amount of 5 to 35 parts by weight per 100 parts by weight of the resin, and subsequently coating the resulting coating with a thermosetting acrylic resin coating composition (B) capable of forming a coating having an elongation of 3 to 30% (at 20° C.) and a glass transition temperature of 60° to 130° C.

25 Claims, No Drawings

METHOD OF COATING AN ALUMINUM WHEEL

The present invention relates to a method of coating wheels in the form of cast aluminum alloy discs and serving as tire attaching members for motor vehicles. (The wheel will hereinafter be referred to as an "aluminum wheel.")

In recent years, aluminum wheels which are excellent in respect of lightweightness, corrosion resistance and design are introduced into use for motor vehicles in place of conventional wheels which are primarily made of steel. To give an improved appearance and enhanced weather resistance, the aluminum wheel is coated, for example, with a transparent or colored thermosetting acrylic resin coating composition of the organic solvent type as a single coat or at least two coats.

However, aluminum wheels have many sharp projections so as to be improved in design. When the conventional acrylic resin coating composition or the like is applied to such a wheel, the flat portions thereof can be given an improved appearance, whereas sharp portions (hereinafter sometimes referred to as "edge portions") permit the composition to flow during baking and are therefore not coatable as desired. Consequently, filiform corrosion occurs at the edge portions and further develops to greatly impair the beauty of the wheel, hence a serious defect. This defect can be obviated effectively by eliminating the sharp edges by grinding, but the additional procedure needed is difficult to incorporate into the production line. Moreover, grinding is not always justifiable from the viewpoint of design. The coating compositions for aluminum wheels have another limitation in that it is difficult to incorporate into the composition the color pigments which are detrimental to the transparency of the coating so as not to impair the unique beautiful appearance of aluminum.

Accordingly, we have conducted intensive research to develop a method of coating aluminum wheels with a composition which is satisfactorily applicable to edge portions free of the above defect, i.e. without the likelihood of flowing of the composition from the edge portions during baking, so as to form coatings which are excellent in formation of coatings on the edge portions, transparency, impact resistance, weather resistance, surface smoothness, adhesion and other physical properties.

Consequently, we have achieved this object by forming an undercoat with a coating composition comprising a thermosetting or thermoplastic resin capable of forming coatings with high flexibility and a specified amount of specific finely divided silica or alumina admixed therewith, and subsequently forming a topcoat with a specified coating composition of thermosetting acrylic resin, whereby the invention has been accomplished.

More specifically, the present invention provides a method of coating an aluminum wheel characterized by coating the wheel with a coating composition (A) comprising a thermosetting or thermoplastic resin having a glass transition temperature of −25° to 60° C. and an elongation of at least 30% (at 20° C.) when in the form of a cured coating, and finely divided transparent silica and/or alumina 0.005 to 0.05 μm in particle size, in an amount of 5 to 35 parts by weight per 100 parts by weight of the resin, and subsequently coating the resulting cating with a thermosetting acrylic resin coating composition capable of forming a coating having an elongation of 3 to 30% (at 20° C.) and a glass transition temperature of 60° to 130° C.

The present invention is characterized in that the coating compositions (A) and (B) are applied to the aluminum wheel to form superposed coatings thereon, whereby the foregoing defect can be substantially obviated or greatly diminished. The coating formed by the composition (A), which consists essentially of the resin having the above-specified values of physical properties, is excellent in flexibility and adhesion, therefore absorbs the energy of impact of pebbles or the like that would strike on the coating during running to remain free of cracking or scaling and does not permit the wheel to develop filiform corrosion. Owing to the presence of the specified finely divided material, the composition (A) exhibits marked thixotropy (becomes pudding-like) and little or no flowability when allowed to stand but greatly decreases in viscosity and restores flowability when stirred. More specifically, when subjected to a high shear for application, the composition becomes applicable by spray coating, whereas the applied composition becomes pudding-like and no longer flowable. The composition is therefore applicable to the edge portions of the aluminum wheel to a large thickness. Moreover, the coating can be baked at a high temperature for curing almost without permitting the flow of the composition even at the edge portions, with the result that the edge portions are coatable as desired.

When not containing the finely divided material, the composition as applied is low in viscosity and thixotropy to exhibit high fluidity, and therefore flows when heated during baking, almost failing to cover the edge portions.

The coating composition (B) has good adhesion to the composition (A) and is satisfactory in weather resistance, hardness, flexibility and durability.

Consequently, the combined coating obtained by the method of the invention, i.e. by applying the coating compositions (A) and (B), has improved ability to cover the edge portions of aluminum wheels, almost eliminates the likelihood of these portions developing filiform corrosion, does not in any way impair the unique metallic appearance of aluminum because it can be colorless and transparent and is excellent in surface smoothness, weather resistance, adhesion and physical properties.

The present invention will be described below in greater detail.

Aluminum wheels

Known wheels made of cast aluminum alloy for motor vehicles such as automobiles, buses, trucks, motorcycles, etc. to be coated by the method of the invention. These wheels are generally treated by shot blasting and worked on by cutting, and are thereafter subjected to chromic or nonchromic chemical conversion (surface) treatment.

Coating composition (A)

A composition comprising 100 parts by weight of a thermosetting or thermoplastic resin having a glass transition temperature of −25° to 60° C. and an elongation of at least 30% (at 20° C.) when in the form of a cured coating, and 5 to 35 parts by weight of finely divided transparent silica and/or alumina ranging from 0.005 to 0.05 μm in particle size. This composition is applied to the aluminum wheel prior to the composition (B).

The thermosetting resin or the thermoplastic resin for use in the coating composition (A) must have such properties that the coating formed only from the resin and cured has an elongation and a glass transition temperature (Tg) in the respective ranges given above. The elongation at 20° C. is at least 30%, preferably 50 to 600%, more preferably 100 to 400%. The Tg is −25° to 60° C., preferably −20° to 55° C., more preferably −10° to 50° C. The coating consisting essentially of a resin which is in the elongation and Tg ranges given above is satisfactory in flexibility, adhesion, etc., almost completely inhibits filiform corrosion of the substrate, is resistant to cracking or scaling even when subjected to an impact of pebbles or the like and substantially retains the original adhesion against deterioration even when subjected to changes in ambient conditions such as changes in temperature and humidity. Accordingly, if the elongation is outside the above range or if the Tg exceeds 60° C., the coating becomes impaired in adhesion when in an environment involving marked changes in temperature or humidity. On the other hand, if the Tg is lower than −25° C., the coating becomes too soft, is liable to defacement when struck on by pebbles or the like and encounters problems during use.

The thermosetting resin is a composition which undergoes a crosslinking curing reaction three dimensionally at room temperature or when heated and which chiefly comprises a base resin and a curing agent. It is required that the reaction product (coating) of the two components have an elongation and Tg in the above ranges. The thermosetting resin to be used can be a known one, such as a mixture of base resin and curing agent capable of forming a coating having the above-mentioned values of properties. Examples of useful base resins are acrylic resin, polyester resin, urethane resin, silicone resin, fluorocarbon resin, butadiene resin, urethane modified polyester resin and the like. Examples of useful curing agents are melamine resin, urea resin (both including mentholated products and alkyletherified products), polyisocyanate compounds (inclusive of blocked products), epoxy resin and the like. Of the resins given above, acrylic resin is desirable because of its high weather resistance and high transparency. The properties of the thermosetting resin are readily adjustable to the foregoing ranges by suitably determining the composition or ratio of the two components, the amount of crosslinking functional groups, curing method, etc. Also useful as thermosetting resins are self-crosslinking resins containing N-n-butoxymethylacrylamide.

The thermoplastic resin is a resin which does not undergo a crosslinking curing reaction, can be plasticized when heated and is capable of forming by suitable means a coating having an elongation and Tg in the foregoing ranges.

Known thermoplastic resins are usable insofar as the coatings prepared therefrom are in the above ranges in the values of physical properties. Examples of such resins are vinyl acetate-ethylene copolymer, linear saturated polyester resin, thermoplastic polyurethane elastomer (high-molecular-weight compound of polyester polyol, polyhydric alcohol or the like as reacted with a diisocyanate compound), styrene-butadiene copolymer, polybutadiene, acrylonitrile-butadiene copolymer, butyl rubber, acrylic resin, modified polyolefin prepared by the graft polymerization of polyolefin with an unsaturated dicarboxylic acid (or anhydride thereof) and the like. The property values of the thermoplastic resin can be easily adjusted by suitably selecting the composition of the resin, the proportions of components thereof, molecular weight, or the like.

The coating composition (A) is made thixotropic by incorporating therein finely divided silica and/or alumina. These materials are in the form of fine particles at least 90 wt. % of which are 0.005 to 0.05 μm, preferably 0.005 to 0.023 μm in size. The silica is finely divided silicic acid or what is termed white carbon. The alumina is also called aluminum oxide. These materials are known as extender pigments for use in coating compositions. If these materials are smaller than 0.005 μm in particle size, the composition becomes excessively higher in viscosity and thixotropy and consequently becomes very difficult to prepare and apply efficiently. On the other hand, if the particle size exceeds 0.05 μm, the composition exhibits reduced thixotropy, fails to completely cover edge portions and is not desirable to use.

The finely divided materials are used in an amount of 5 to 35 parts by weight, preferably 15 to 25 parts by weight, per 100 parts by weight of the thermosetting resin and/or the thermoplastic resin. When the amount is less than 5 parts by weight, the composition fails to fully cover edge portions, whereas amounts over 35 parts by weight result in impaired coatability, hence undesirable.

The coating composition (A) consists primarily of the thermosetting resin and/or thermoplastic resin, and finely divided silica and/or alumina stated above. These materials are dissolved or dispersed in an organic solvent to obtain the composition.

The organic solvent to be used is not limited specifically but can be any of usual solvents for coating compositions. However, it is desirable to use a polar organic solvent and a nonpolar organic solvent in mixture. The boiling point of these solvents is usually up to 130° C., preferably 100° to 120° C., for the former, and is usually 105° to 250° C., preferably 110° to 210° C., for the latter. Based on the combined weight of the two solvents, it is suitable to use 10 to 70%, preferably 15 to 50%, of the former, and 90 to 30%, preferably 85 to 50%, of the latter. The polar solvent imparts fluidity to the coating composition (A), contributing to improvements in coating efficiency and the surface smoothness of the resulting coating. The nonpolar solvent imparts thixotropy to the coating composition (A), prevents excessive fluidization of the coating during baking and enables the composition to cover edge portions effectively.

The polar solvent is one capable of effectively dissolving various resins and having chemical activity and relatively high electrical conductivity. Preferably it is an organic solvent at least 4.0ε·20° C. in dielectric constant. For example, it is a solvent having in the molecule a polar group such as hydroxyl or carbonyl group or ester linkage and having a boiling point of up to 130° C. If the boiling point is higher than 130° C., the composition applied to the substrate exhibits reduced thixotropy and is liable to flow when heated, possibly failing to fully cover edge portions.

Examples of useful solvents are ketones such as acetone, methyl ethyl ketone, methyl isobutyl ketone and diethyl ketone, esters such as ethyl acetate and isobutyl acetate, alcohols such as n-butanol and isobutanol, etc. Among these, methyl isobutyl ketone, diethyl ketone, isobutyl acetate, n-butanol and isobutanol are desirable to use.

The nonpolar solvent is chemically inactive and is preferably less than 4.0ε·20° C. in dielectric constant. The solvent is free from the above-mentioned polar groups and usually ranges from 105° to 250° C. in boiling point. When the boiling point is lower than 105° C., the composition applied tends to exhibit impaired surface smoothness and fail to cover edge portions effectively, whereas if the boiling point is higher than 250° C., the coating is liable to flow, possibly failing to completely cover edge portions. Examples of useful nonpolar organic solvents are aromatic hydrocarbons such as toluene and xylene, mineral spirit, aromatic petroleum naphthas such as SWASOL #1000, SWASOL #1500 and SWASOL #1900 (brand names, products of KOSUMO OIL Co., Ltd.). Of these, xylene, toluene and the aromatic petroleum naphthas are desirable to use.

To prepare the coating composition with greater ease and to obtain coatings of improved surface smoothness, it is especially desirable to use as the nonpolar solvent the mixture of a nonpolar solvent having a boiling point of 105° to lower than 150° C. and a nonpolar solvent having a boiling point of at least 150° but up to 250° C., in the proportions of 30 to 70% of the former and 70 to 30% of the latter based on the combined weight of the solvents.

Although the method of applying the coating composition (A) is not limited specifically, it is especially suitable to resort to a spray coating method such as air spraying, airless spraying or electrostatic coating in view of the great ease and high efficiency of the operation. It is desirable that the coating composition to be thus applied be adjusted to a solids content of 15 to 50 wt. %, preferably 20 to 40 wt. %.

When required, the aluminum wheel can be surface-treated by a usual method and further coated with an undercoat or intermediate-coat composition before the application of the composition (A). It is desired to apply the composition (A) to such a thickness that the coating formed on the flat surface portion of the wheel has a thickness of 10 to 50 μm when cured. Although it is not essential to cure the coating of composition (A) before the application of the composition (B), it may be cured at ambient temperature or at an elevated temperature of up to 170° C.

Coating composition (B)

A thermosetting acrylic resin composition capable of forming a coating which is 3 to 30% in elongation at 20° C. and 60° to 130° C. in Tg. This composition is applied to the coating of the composition (A). More specifically, the composition is a known thermosetting acrylic resin coating composition having the above-specified properties and capable of forming coatings which are excellent in finished appearance (such as distinction of image gloss, surface smoothness and gloss), weather resistance (such as gloss retentivity, color retentivity and chalk resistance), chemical resistance, water resistance, curability, etc. The composition can be of any type such as organic solution type, nonaqueous dispersion type, aqueous solution (dispersion) type, powder type, high-solid type or the like. For example, such a composition comprises an acrylic resin (about 10,000 to 100,000 in number average molecular weight, 15 to 100 in hydroxyl value and 0 to 100 in acid value) having at least one functional group selected from among hydroxyl, glycidyl and like groups, and at least one curing agent selected from among amino resin, urea resin, polyisocyanate compound, block polyisocyanate compound, dibasic acid compound and the like.

The coating composition (B) can be either an enamel composition prepared by admixing a metallic pigment and/or a coloring pigment with the above composition composed chiefly of an acrylic resin and a curing agent, or a clear coating position completely or almost free from such pigments.

For a metallic finish, the so-called 2ClB (2-coat 1-bake) method is generally used wherein the composition (B) in the form of a metallic base composition is applied first to a thickness of 10 to 15 μm and subsequently applying the composition (B) in the form of a clear coating composition to a thickness of 20 to 80 μm. Further to cover edge portions more completely and obtain an improved finish, the composition (B) may be applied repeatedly to form three or four coats.

The coating composition (B) can be applied on the cured or non-cured coating of composition (A) by the same method as the composition (A) to such a thickness that the coating has a thickness of 20 to 80 μm, preferably 25 to 60 μm, when cured. The coating of composition (B) is preferably cured at ambient temperature or at an elevated temperature of up to 170° C.

It is critical that when the composition (B) is singly applied, the resulting coating have an elongation of 3 to 30%, preferably 5 to 20%, more preferably 5 to 15%, and Tg of 60° to 130° C., preferably 60° to 110° C. When less than 3% in elongation, the coating of the composition (B) is low in flexibility and prone to cracking, whereas if the elongation is greater than 30%, the coating has low hardness. When the Tg is lower than 60° C., the coating becomes soft, whereas if it is higher than 120° C., reduced flexibility will result, hence undesirable.

The elongation (tensile break elongation) of the coating of each of the compositions (A) and (B) is a value measured using a universal tensile tester having a constant-temperature chamber (Autograph Model S-D, product of Shimadzu Seisakusho Corp.) and 20 mm long specimens at 20° C. and at a tensile rate of 20 mm/min. The specimens used for the measurement were prepared by coating a sheet of tinplate with the composition to a thickness of 60 μm (when cured), baking the coating at 140° C. for 30 minutes and isolating the coating by the mercury-amalgam method.

The glass transition temperature of the coating of each composition was determined using a dynamic viscoelastometer, Model VIBRON DDV-II-EA (product of Tokyo Bacdwin Co., Ltd.). The specimens used were prepared in the same manner as above.

The coating formed on an aluminum wheel by the method of the invention, i.e. by applying the composition (A) to the wheel, applying the composition (B) to the coating and heating the resulting coating, with or without curing the first coating before the application of the composition (B), has the feature that it is more satisfactory than the coating formed without applying the composition (A) in finished appearance (e.g. surface smoothness, gloss, distinction of image gloss, etc.), water resistance and the like and is greatly improved in impact resistance, corrosion resistance of the edge portions, physical properties, weather resistance, etc.

Examples of the invention and comparative examples are given below.

I. Preparation of specimens (1) Substrate

Cast aluminum panels (100×150×8mm) prepared by cutting, followed by chemical conversion treatment with Bonderite BT3753 (product of Nihon Parkerizing Co., Ltd.). (2) Coating composition (A)

The components given in Table 1 were dispersed in the listed amounts into a solvent by mixing to prepare each coating composition (A).

The solvent was composed of n-butanol, isobutanol, methyl isobutyl ketone (all polar), and SWASOL #1000 and SWASOL #1500 (both nonpolar, brand names for products of KOSUMO OIL Co., Ltd.). Each composition was adjusted to a solids concentration of 35 to 38 wt. %.

TABLE 1

| | (A-1) | (A-2) | (A-3) | (A-4) | (A-5) | (A-6) | (A-7) | (A-8) |
|---|---|---|---|---|---|---|---|---|
| Base resin (*1) | | | | | | | | |
| Name | a-1 | a-2 | a-3 | a-4 | a-5 | a-4 | a-4 | a-5 |
| Curing agent (*2) | | | | | | | | |
| Name | — | — | b-1 | — | b-2 | — | — | b-2 |
| Amount | — | — | 65 | — | 40 | — | — | 40 |
| Finely divided material (*3) | | | | | | | | |
| Name | c-1 | c-2 | c-1 | c-1 | c-3 | — | c-4 | c-3 |
| Amount | 16 | 18 | 20 | 22 | 24 | — | 22 | 40 |

II. EXAMPLES AND COMPARATIVE EXAMPLES

Each of the coating compositions A-1 to A-8 was applied to the substrate by spray coating to a thickness of 30 μm when cured on the flat portion and was allowed to stand for 5 minutes. Without baking, the coating was thereafter coated with the composition B-1 or B-2 to a thickness of 30 to 60 μm when cured and was subsequently heated at 140° C. for 30 minutes or at 150° C. for 30 minutes for curing.

Table 2 shows the coating steps, characteristics values of the coatings, and the results obtained by testing the resulting coating.

TABLE 2

| Example | 1 | 2 | 3 | 4 | 5 | 6 | 7 |
|---|---|---|---|---|---|---|---|
| Step | | | | | | | |
| Coating composition (A) | | | | | | | |
| Name | A-1 | A-2 | A-3 | A-3 | A-4 | A-5 | A-5 |
| Coating thickness (μm) (at flat portion) | 25 | 25 | 25 | 25 | 25 | 25 | 25 |
| Elongation (%) | 400 | 400 | 250 | 250 | 300 | 230 | 230 |
| Tg (°C.) | −10 | 6 | 10 | 15 | 48 | 45 | 45 |
| Coating composition (B) | | | | | | | |
| Name | B-1 | B-2 | B-1 | B-2 | B-1 | B-1 | B-2 |
| Coating thickness (μm) (at flat portion) | 30 | 60 | 30 | 60 | 30 | 30 | 60 |
| Elongation (%) | 7 | 10 | 7 | 10 | 7 | 7 | 10 |
| Tg (°C.) | 83 | 105 | 83 | 105 | 83 | 83 | 105 |
| Test results | | | | | | | |
| Salt spray resistance | | | | | | | |
| Coating thickness (μm) (at edge portion) | 11 | 10 | 12 | 12 | 15 | 14 | 14 |
| Edge portion | | | | | | | |
| Flat portion | | | | | | | |
| Resistance to filiform corrosion | | | | | | | |
| Edge portion | | | | | | | |
| Flat portion | | | | | | | |
| Scab corrosion resistance | | | | | | | |
| Edge portion | | | | | | | |
| Flat portion | | | | | | | |
| Impact resistance | | | | | | | |
| Resistance to cold and heat cycles | | | | | | | |
| Adhesion | 100 | 100 | 100 | 100 | 100 | 100 | 100 |
| Weather Resistance | | | | | | | |
| Appearance of finished surface | | | | | | | |

TABLE 2-continued

| Comparative Example | 1 | 2 | 3 | 4 | 5 |
|---|---|---|---|---|---|
| Step | | | | | |
| Coating composition (A) | | | | | |
| Name | — | — | A-6 | A-7 | A-8 |
| Coating thickness (μm) (at flat portion) | — | — | 25 | 25 | 25 |
| Elongation (%) | — | — | 450 | 300 | 230 |
| Tg (°C.) | — | — | 48 | 48 | 45 |
| Coating composition (B) | | | | | |
| Name | B-1 | B-2 | B-1 | B-1 | B-1 |
| Coating thickness (μm) (at flat portion) | 30 | 60 | 30 | 30 | 30 |
| Elongation (%) | 7 | 10 | 7 | 7 | 7 |
| Tg (°C.) | 83 | 105 | 83 | 83 | 83 |
| Test results | | | | | |
| Salt spray resistance | | | | | |
| Coating thickness (μm) (at edge portion) | 0 | 0 | 0 | 2 | 14 |
| Edge portion | X | X | X | X | |
| Flat portion | | | | | |
| Resistance to filiform corrosion | | | | | |
| Edge portion | X | X | X | X | |
| Flat portion | | | | | |
| Scab corrosion resistance | | | | | |
| Edge portion | X | X | X | X | |
| Flat portion | | | | | |
| Impact resistance | | | | | Δ |
| Resistance to cold and heat cycles | | | | | |
| Adhesion | 100 | 100 | 100 | 100 | 100 |
| Weather Resistance | | | | | |
| Appearance of finished surface | | | | | X |

The properties listed in Table 2 were determined by the following methods.

(1) The coating thickness was measured after the coating was cured.

(2) The elongation and Tg were measured by the methods already described and are expressed in % and °C., respectively.

(3) Salt spray resistance

The coating thickness at edge portion was determined by applying the composition to a cutter blade for office work and measuring the thickness of the coating formed on the edge portion of the blade and cured under a stereomicroscope at X120. For the determination of salt spray resistance, the coated blade (edge portion) and the coated substrate (flat portion) with its coating cut crosswise to the substrate surface were subjected to salt spray testing for 500 hours, and the width of the resulting creep at one side of the edge, as well as the cross cut, was measured. The measurements are expressed by the following symbols.

O: Less than 2 mm

Δ: 2 to 4 mm

X : Over 4 mm (4) Resistance to filiform corrosion

The coated substrate having its coating cut in two diagonal lines to the substrate surface with a cutter and the same coated cutter blade as used in the procedure (3) above were placed in a salt spray tester according to JIS Z2371 for 24 hours, then washed with deionized water over the coating and placed in a constant-temperature constant-humidity chamber (temperature 40°±2° C., humidity 85±2%). After repeating this cycle 5 times, the test pieces were checked for the development of filiform corrosion in terms of the width of the resulting creep at one side of the cross cut and of the edge. The results are expressed by the following symbols.

O: Less than 2 mm in creep width

Δ: 2 to 4 mm in creep width

X : Over 4 mm in creep width (5) Scab corrosion resistance

Two test pieces the same as those used in the procedure (4) above were immersed in hot water at 40° C. for 120 hours, then dried at 20° C. for 4 hours and thereafter treated three times a week by the method of: immersion in 5% aqueous solution of sodium chloride for 2 hours (30° C.) standing at −20° C. for one hour→ outdoor exposure for 45 hours. After repeating this cycle 10 times, the test pieces were checked for the state of the coating surface. The results are expressed by the following symbols.

O: Free of any corrosion

Δ: Slight corrosion

X: Marked corrosion (6) Impact resistance

Determined by the method of JIS K5400-1979 6.13.3B in an atmosphere of 20° C. A 500-gram weight was dropped onto the coated substrate from 50 cm thereabove, and the coating was checked for the resulting damage. The results are expressed by the following symbols.

O: No change

Δ: Slight cracking or scaling

X: Marked cracking or scaling (7) Resistance to cold and heat cycles

The coated panel was allowed to stand at 80° C. for 2 hours, then at −10° C. for 4 hours and thereafter at room temperature for 2 hours. After repeating this cycle times, the coating was checked.

O: No scaling or cracking

Δ: Slight scaling or cracking

X: marked scaling or cracking (8) Adhesion

Determined by subjecting the coated substrate to accelerated weathering for 500 hours using a Sunshine Weather-Ometer, thereafter making 100 squares, 1 mm×1 mm, in the coating by cross-cutting according to JIS K5400-1979 6.15, applying an adhesive cellophane tape to the coating, rapidly removing the tape and counting the number of squares remaining on the coating.

(9) Weather resistance

The coated aluminum panel was exposed to weather for one year at Chikura, Chiba Prefecture, Japan. The coating was thereafter checked. The results are expressed by the following symbols.

O: No filiform corrosion

Δ: Slight filiform corrosion

X: Marked filiform corrosion

(10) Appearance of finished surface

Evaluated with the unaided type according to the following criteria.

O: Excellent in surface smoothness, gloss and distinction of image gloss

Δ: Slightly poor in surface smoothness, gloss and distinction of image gloss

X: Very poor in surface smoothness, gloss and distinction of image gloss

We claim:

1. A method of coating an aluminum wheel comprising:

coating the aluminum wheel with a coating composition (A) comprising a thermosetting or thermoplastic resin having a glass transition temperature of −25° to 60° C. and an elongation of at least 30% (at 20° C.) when in the form of a cured coating, and finely divided transparent silica and/or alumina 0.005 to 0.05 μm in particle size, in an amount of 5 to 35 parts by weight per 100 parts by weight of the resin, and subsequently coating the resulting coating with a thermosetting acrylic resin coating composition (B) capable of forming a coating having an elongation of 3 to 30% (at 20° C.) and a glass transition temperature of 60° to 130° C.

2. A method as defined in claim 1 wherein the coating composition (A) comprises a thermosetting or thermoplastic resin having an elongation of 50 to 600% (at 20° C.) and a glass transition temperature of −20° to 55° C. when in the form of a cured coating.

3. A method as defined in claim 2 wherein the coating composition (A) comprises a thermosetting or thermoplastic resin having an elongation of 100 to 400% (at 20° C.) and a glass transition temperature of −10° to 50° C. when in the form of a cured coating.

4. A method as defined in claim 1 wherein the coating composition (A) comprises a thermosetting resin comprising at least one base resin selected from the group consisting of acrylic resin, polyester resin, urethane resin, silicone resin, fluorocarbon resin, butadiene resin and urethane modified polyester resin, and at least one curing agent selected from the group consisting of melamine resin, urea resin, polyisocyanate compound and epoxy resin.

5. A method as defined in claim 1 wherein the coating composition (A) comprises a self-crosslinking resin containing N-n-butoxymethylacrylamide.

6. A method as defined in claim 1 wherein the coating composition (A) comprises at least one thermoplastic resin selected from the group consisting of vinyl acetate-ethylene copolymer, linear saturated polyester resin, thermoplastic polyurethane elastomer, styrenebutadiene copolymer, polybutadiene, acrylonitrilebutadiene copolymer, butyl rubber, acrylic resin and modified polyolefin.

7. A method as defined in claim 1 wherein the coating composition (A) comprises finely divided transparent silica and/or alumina 0.005 to 0.23 μm in particle size.

8. A method as defined in claim 1 wherein the amount of the finely divided transparent silica and/or alumina is 15 to 25 parts by weight per 100 parts by weight of the resin component of the coating composition (A).

9. A method as defined in claim 1 wherein the coating composition (A) is dispersed in a mixture of a polar organic solvent having a boiling point of up to 130° C. and a nonpolar organic solvent having a boiling point of 105° to 250° C.

10. A method as defined in claim 9 wherein the coating composition (A) is dispersed in a mixture of a polar organic solvent having a boiling point of 100° to 120° C. and a nonpolar organic solvent having a boiling point of 110° to 210° C.

11. A method as defined in claim 9 wherein the solvent mixture comprises 10 to 70% of the polar organic solvent and 90 to 30% of the nonpolar organic solvent.

12. A method as defined in claim 11 wherein the solvent mixture comprises 15 to 50% of the polar organic solvent and 85 to 50% of the nonpolar organic solvent.

13. A method as defined in claim 9 wherein the polar organic solvent is at least one solvent selected from the group consisting of ketones, esters and alcohols.

14. A method as defined in claim 13 wherein the polar organic solvent is at least one solvent selected from the group consisting of acetone, methyl ethyl ketone, methyl isobutyl ketone, diethyl ketone, ethyl acetate, isobutyl acetate, n-butanol and isobutanol.

15. A method as defined in claim 14 wherein the polar organic solvent is at least one solvent selected from the group consisting of methyl isobutyl ketone, diethyl ketone, isobutyl acetate, n-butanol and isobutanol.

16. A method as defined in claim 9 wherein the nonpolar organic solvent is at least one solvent selected from the group consisting of aromatic hydrocarbons, mineral spirit and aromatic petroleum naphthas.

17. A method as defined in claim 16 wherein the nonpolar organic solvent is at least one solvent selected from the group consisting of toluene, xylene, mineral spirit and aromatic naphtha.

18. A method as defined in claim 9 wherein the nonpolar organic solvent comprises a mixture of 30 to 70% of a component having a low boiling point of 105° to less than 150° C. and a component having a high boiling point of 150° to 250° C.

19. A method as defined in claim 1 wherein the coating composition (A) is applied at a solids concentration of 15 to 50 wt. % by spray coating.

20. A method as defined in claim 19 wherein the coating composition (A) is applied at a solids concentration of 20 to 40 wt. % by spray coating.

21. A method as defined in claim 1 wherein the coating composition (B) comprises an acrylic resin having a number average molecular weight of about 10000 to about 100000, a hydroxyl value of 15 to 100 and an acid value of 0 to 100, and at least one curing agent selected from the group consisting of amino resin, urea resin, polyisocyanate compound, block polyisocyanate compound and dibasic acid compound.

22. A method as defined in claim 1 wherein the coating composition (B) is of the enamel type further comprising a metallic pigment and/or coloring pigment.

23. A method as defined in claim 1 wherein the coating composition (B) is of the clear type substantially free from a metallic pigment and/or coloring pigment.

24. A method as defined in claim 1 wherein the coating composition (B) comprises a thermosetting acrylic resin capable of forming a cured coating having an elongation of 5 to 20% (at 20° C.) and a glass transition temperature of 60 to 110° C.

25. A method as defined in claim 24 wherein the coating composition (B) comprises a thermosetting acrylic resin capable of forming a cured coating having an elongation of 5 to 15% (at 20° C.).

* * * * *